United States Patent [19]

Rigby

[11] Patent Number: 4,832,199

[45] Date of Patent: May 23, 1989

[54] AUTO LOCK DISPLAY TRAY

[75] Inventor: William R. Rigby, Elkton, Md.

[73] Assignee: Westvaco Corporation, New York, N.Y.

[21] Appl. No.: 124,247

[22] Filed: Nov. 24, 1987

[51] Int. Cl.[4] ..... B65D 5/50

[52] U.S. Cl. ..... 206/485; 206/45.19; 206/576; 229/168; 229/173

[58] Field of Search ..... 206/45.14, 45.16, 45.19, 206/485, 561, 562, 564, 557, 558, 526; 229/172, 173, 167, 168

[56] References Cited

U.S. PATENT DOCUMENTS

| | | | |
|---|---|---|---|
| 1,616,047 | 2/1927 | Hoge | 206/45.14 |
| 2,620,962 | 12/1952 | Powell | 206/45.19 |
| 3,405,860 | 10/1968 | Manizza | 206/485 |
| 3,927,761 | 12/1975 | Boyle | 206/45.14 |
| 4,485,922 | 12/1984 | Desmond et al. | 206/485 |

FOREIGN PATENT DOCUMENTS

| | | | |
|---|---|---|---|
| 2573038 | 5/1986 | France | 229/172 |
| 701212 | 12/1953 | United Kingdom | 206/485 |

*Primary Examiner*—Bryon P. Gehman

[57] ABSTRACT

An auto lock tray is formed from a single blank of cut and scored foldable material comprising a bottom panel, side and end walls extending in an upright condition at each edge of the bottom panel and diagonally disposed product supporting panels interiorly of the tray which extend from the upper edges of the side walls downwardly at acute angles with the bottom of the tray. The product supporting panels are retained in position within the tray by a pair of locking flaps including interengaged tabs and slots which become fully engaged as a result of an over center folding action.

2 Claims, 3 Drawing Sheets

AUTO LOCK DISPLAY TRAY

BACKGROUND OF INVENTION

The present invention relates generally to trays and more particularly to a tray with auto locked side walls and end walls including angularly disposed interior product supporting panels.

Most trays of this type currently available are either pre-glued and collapsed for shipment at the point of manufacture, or they are set up and glued at the point of use using special tools and equipment. Once formed, the trays are difficult to inventory because they will not nest. For this reason, it would be desirable to have available a tray construction which can be readily set up either by hand or by machine at the point of use without glued joints, staples or the like.

SUMMARY OF INVENTION

The present invention comprises a packaging tray which is constructed from a flat blank of paperboard material having auto lock side and end walls with diagonally disposed interior product supporting panels which are also automatically locked together. The tray is set up for use without the aid of glued joints, staples or the like and comprises a unique locking feature for positioning and maintaining the diagonally disposed interior product supporting panels in place in the tray.

The tray includes a substantially rectangular bottom panel, side walls extending upwardly from two opposite sides of the bottom panel, and end walls extending upwardly from the remaining opposing sides of the bottom panel. Corner connecting flaps are provided at each end of each side wall which are folded inside and captured between the end walls and end wall locking flaps when the tray is set up. For this purpose, a pair of end wall locking flaps are foldably attached to the upper edges of the end walls. The end wall locking flaps are each provided with two or more locking tabs which cooperate with slots provided in the bottom panel along the fold lines between the bottom panel and the end walls. In the first stage of assembly of the tray, the side walls are folded into their upright condition and the corner connecting flaps are captured between the end walls and end wall locking flaps. This step effectively retains all four side walls of the tray in an upright condition. Meanwhile a pair of product retaining interior panels are foldably attached to the upper edges of the side walls. These panels are provided with slots for positioning and retaining products packaged in the tray. In the preferred embodiment, the slots are prepared in the form of elongated openings located adjacent to the upper edges of the side walls with narrow cuts or slits extending therefrom to the interior panel locking flaps. It will be obvious to one skilled in the art that these product retaining openings may take any desired shape depending upon the product to be packaged. The interior panels are preferably designed to extend from the upper edges of the side walls interiorly of the tray at acute angles with the bottom panel. A plurality of panel support flaps are provided at the ends of the interior panels for positioning and supporting the ends of the interior panels in their angularly oriented positions. These flaps are designated with two edges which abut respectively the bottom panel and the side walls at each corner of the tray. Finally, the means for retaining the interior panels in place within the tray includes a pair of interior panel locking flaps with interlocking tabs and slots. These flaps are designed to interlock with one another as a result of an over center auto locking function so as to lie in a plane in contact with an immediately above the bottom panel of the tray. For this purpose, the locking flaps are sized so as to overlap one another in their unlocked condition but become interlocked when they are urged past their over center position into the tray. The means for locking the end walls and side walls in their upright condition and the means for locking the product supporting panels inside the tray may be performed by hand or machine without the aid of glue flaps, staples or the like.

Accordingly, it is an object of the present invention to provide a packaging tray of the auto lock type which is prepared from a single blank of paperboard or the like and shipped in flat conditon to be formed at the point of use.

It is another object of the present invention to provide such a package which may bre formed without the aid of glued joints, staples or the like.

It is yet another object of the present invention to provide such a package with unique product supporting interior walls and an over center locking means for keeping the interior panels in place within the tray. These and other desireable objects and features will become apparent from the accompanying drawing and detailed description.

DETAILED DESCRIPTION

Figure 1:
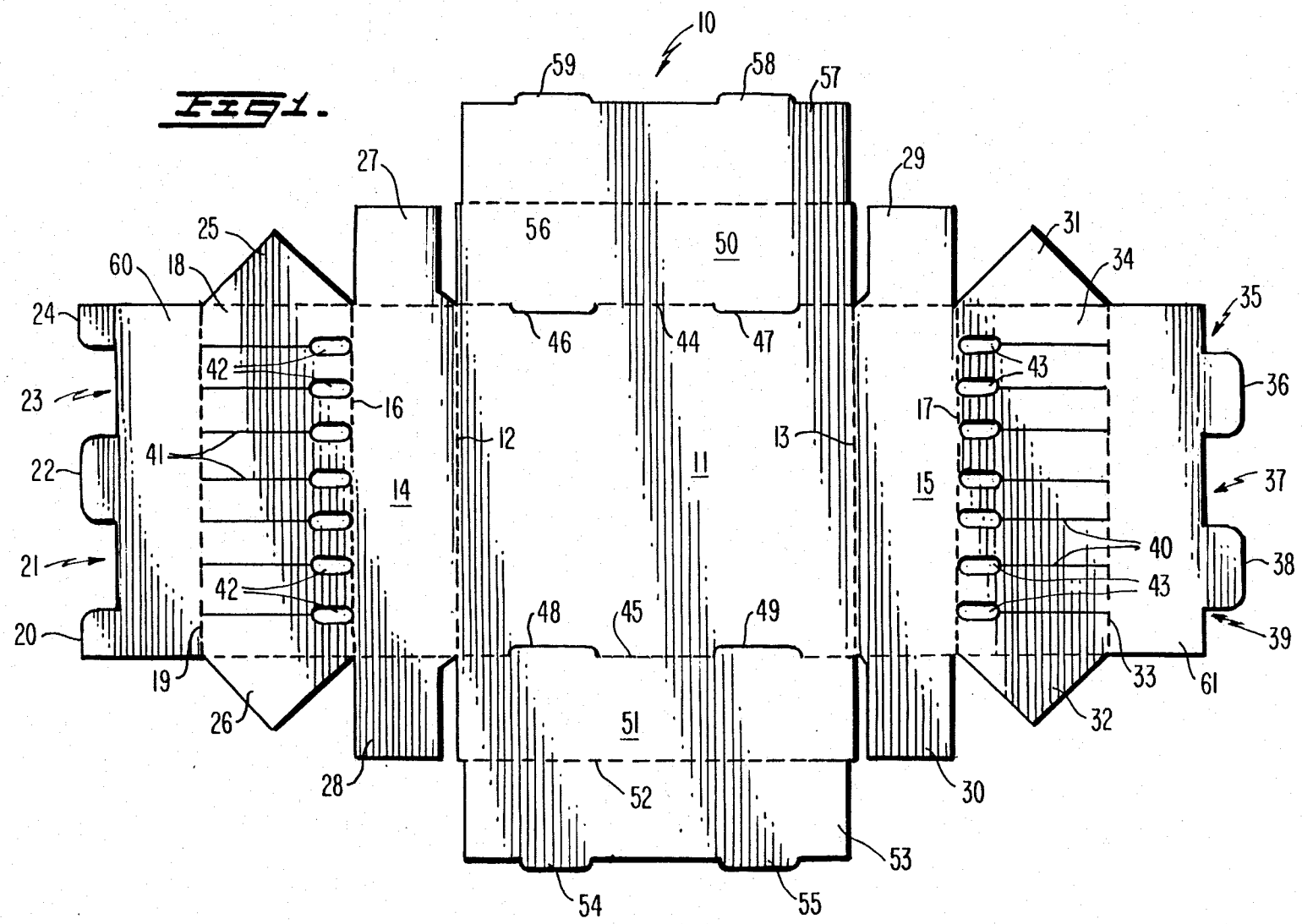
FIG. 1 is a plan view of a typical blank structure for use in preparing the tray of the present invention.
Figure 2:
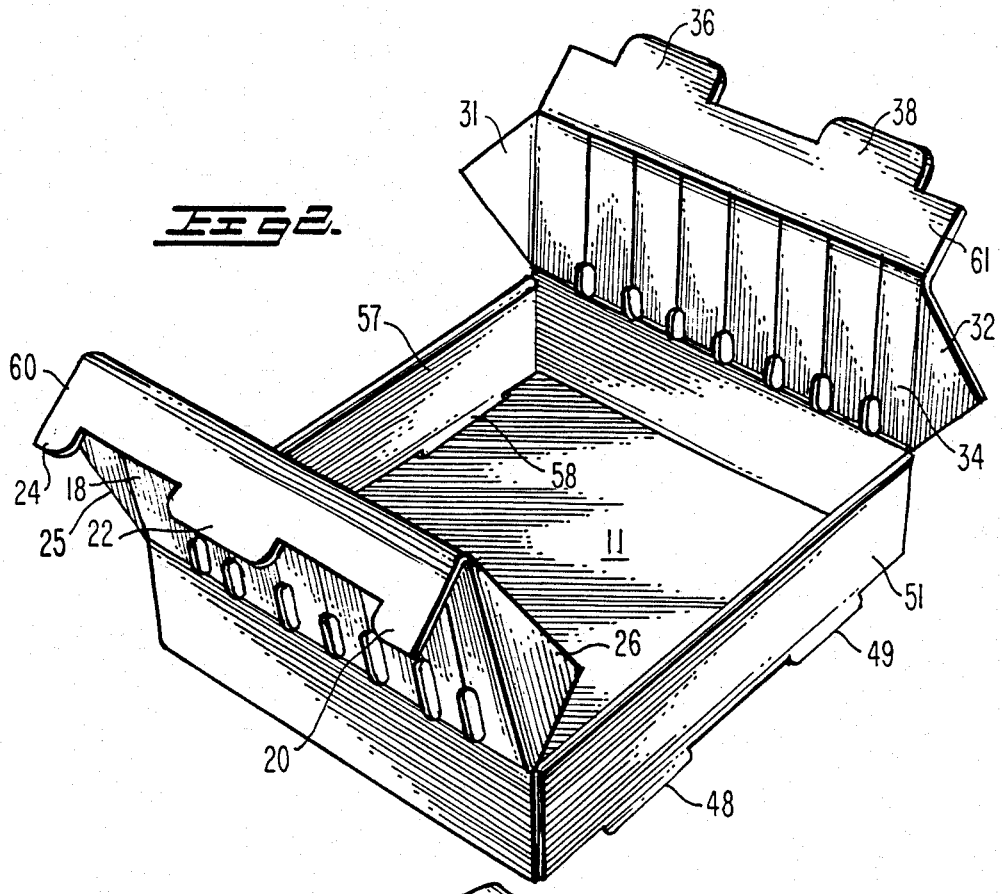
FIG. 2 is a perspective view of a partially formed tray prepared from the blank of FIG. 1.

FIG. 1 illustrates a typical blank structure for use in forming the tray of the present invention. The blank 10 includes a substantially rectangular bottom panel 11, two opposed side walls 14, 15 foldably attached to opposite sides of the bottom panel 11 along fold lines 12 and 13, and a pair of end walls 50, 51 foldably attached to the remaining opposite ends of the bottom panel along fold lines 44, 45. In addition to these panels, there are a pair of product supporting interior panels 18 and 34 foldably attached respectively to the side walls 14 and 15 along fold lines 16 and 17, and a pair of locking flaps 60 and 61 foldably attached to the product supporting interior panels 18 and 34 along scored lines 19 and 33. At the ends of the tray, a second pair of end locking flaps 53 and 57 are foldably attached to the end walls 50, 51 along score lines 52 and 56. The end locking flaps 53 and 57 are designed to overlap and capture corner connecting flaps 27, 28, 29 and 30, attached to side walls 14 and 15, in the initial step in setting up the tray as shown in FIG. 2. The end walls and side walls of the tray are held in an upright condition as a result of the engagement of locking tabs 54, 55 and 58, 59 which become engaged in slots 48, 49 and 46, 47 formed by cut lines along the score lines 44, 45 at the ends of the bottom panel 11. This is a conventional method of setting up a tray as will be appreciated by those skilled in the art. Thus the novelty of the present invention lies in the means and method whereby the product supporting interior panels 18 and 34 are positioned within the tray and held in place.

Figure 4:
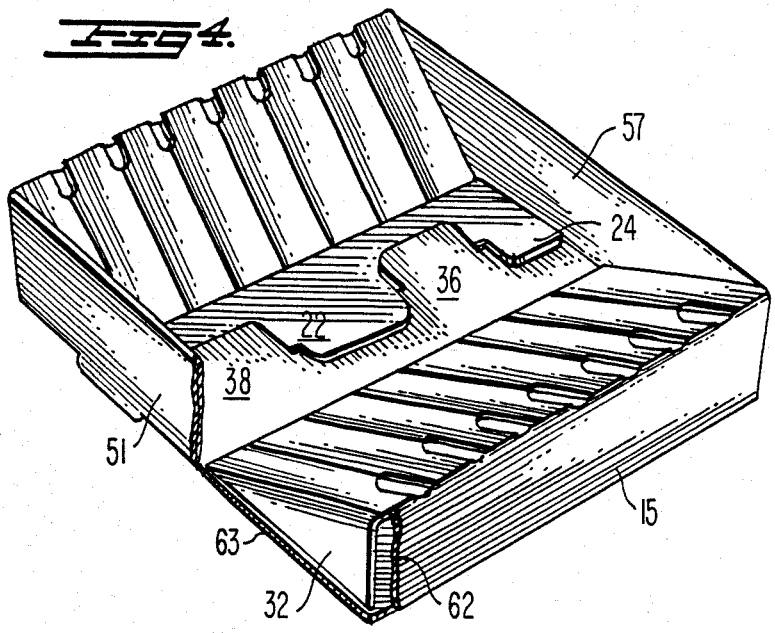
FIG. 4 is a view similar to FIG. 3 showing the fully formed tray.
Figure 5:
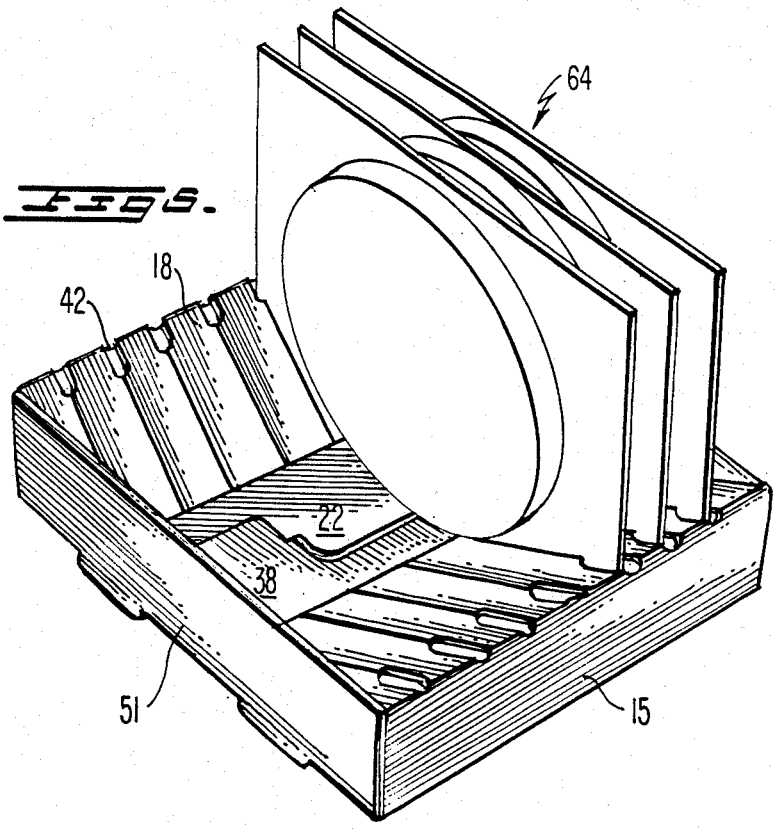
FIG. 5 is a perspective view of a formed tray containing products.

The product supporting interior panels 18 and 34 are each provided with a plurality uniformly spaced openings 42 and 43 located along the scored lines 16 and 17. The openings 42 and 43 may take any desired shape depending upon the product to be packaged, but are preferably elongated with an aspect ratio of about 3 to 1. One end of each opening 42 or 43 is arranged to lie along the scored lines 16 or 17 while a cut line 40 or 41 is arranged to extend in the panels 18, 34 from the opposite end of each opening to the scored lines 19 and 33. The cut lines 40 and 41 are designed to allow the packaged products to be fully inserted through the interior product supporting panels 18, 34 and into contact with the bottom 11 of the tray. However, the narrow gap createed by the cut lines 40, 41 provides an effective frictional restraint against inadvertent loss or removal of the individually packaged products. If desired, and depending upon the type of product packaged in the tray, the openings 42, 43 could be continued uniformly throughout the interior support panels 18, 34 all the way to the fold lines 17, 19. Meanwhile the edge flaps 25, 26 connected to panel 18, and 31, 32 connected to panel 34, play significant roles in providing support for the ends of the product supporting panels. These flaps are sized and cut so that the outer edges thereof 62 and 63 abut respectively the side walls 14, 15 of the tray and the bottom panel 11 when the tray is fully formed as shown in FIG. 4.

Figure 3:
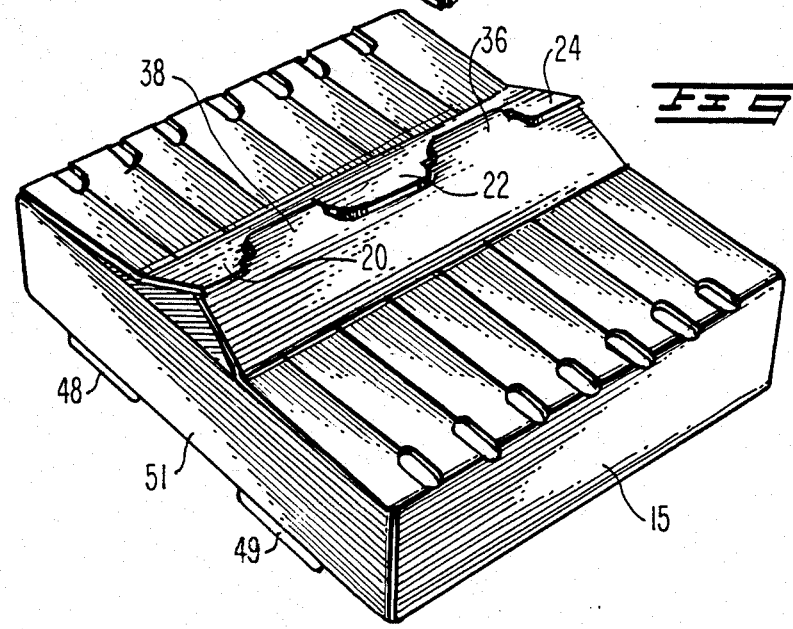
FIG. 3 is a perspective view of a second forming step in the set-up process for the tray.

In FIG. 3, the second step in forming the tray is illustrated wherein the locking flaps 60 and 61 are folded upwardly about scored lines 19 and 33 to that the tabs 20, 22 and 24 of the flap 60 become engaged in slots 35, 37 and 39 of flap 61, and the tabs 36, 38 of flap 61 become engaged in slots 21 and 23 of flap 60. Because the flaps 60 and 61 substantially fully overlap one another in their unlocked condition, (i.e., when lying in a plane defined by the top of the tray), they must be folded upwardly with respect to one another to allow the tabs and slots to become initially engaged. Once the tabls and slots are engaged, the application of pressure urging the flaps into the bottom of the tray causes the flaps to pass through a substantially aligned, or center position which creates an over center action to cause the flaps to snap downwardly and become fully engaged as shown in FIG. 4. In this position, the flaps 60, 61 becme essentially permanently locked together while the product supporting panels assume their sloped condition within the tray. The tray can be disassembled by lifting the tabs 36, 38 and/or 20, 22 and 24 with care, past their over center position, but this task is difficult and not readily accomplished.

It will be appreciated by those skilled in the art that depending upon the tray dimensions, it might be desireable to use one or more locking tabs/slots on each locking flap 60, 61. The essence of the invention is that the flaps 60, 61 extend from their respective fold lines 19 and 33 a distance so as to be substantially fully overlapped when they lie in the plane of the top of the tray. The width of each slot 21, 23 and 35, 37, 39 is cut so as to exactly match the width of each tab 20, 22, 24 and 36, 38 when the flaps are urged downwardly into contact with the bottom of the tray. In this manner the tray remains fully set up without the aid of glued joints, staples or the like while the product is loaded and during shipment.

It may be seen that the tray of the present invention is prepared from a single blank of paperboard or the like wherein the end walls and side walls are readily locked in place by hand or machine. The blank is generally rectangular in shape to produce a substantially rectangular tray. All parts of the blank are cut and scored to fully cooperate with one another in the final assembly to produce a self locking construction. This arrangement positions the product supporting interior panels in an angular relationship with respect to the tray bottom and side walls to accept the packaged products.

What is claimed is:

1. An auto lock tray prepared from a single blank of material comprising:

(a) a substantially centrally located bottom panel of generally rectangular shape having paired side and end walls foldably attached thereto, said side and end walls having upper edges and ends with corner connecting flaps foldably attached to the ends of said side walls, and a first pair of locking flaps foldably attached to the upper edges of said end walls, said locking flaps each include two or more locking tabs on the outer edges thereof which cooperate with locking slots formed in the bottom panel along the fold lines foldably attaching the end walls to the bottom panel and the corner connecting flaps are each captured between an end wall and a locking flap to form the tray with upstanding side and end walls;

(b) a pair of product supporting panels one foldably attached to the upper edge of each of said side walls and located inside the tray at an acute angle with respect to said bottom panel, said product supporting panels each including a plurality of matching product accepting slots for accepting and retaining products packaged in the tray and a panel support flap at each end of said product supporting panel for supporting the ends of the product supporting panels, each of said panel support flaps having adjacent edges which abut respectively the bottom panel and a side wall of the tray at a corner of the tray; and, (c) a second pair of locking flaps one foldably attached to the inner side of each of said product supporting panels, said second locking flaps each including alternating tabs and slots formed at their outer edges which interlock in the over center position of said locking flaps, said flaps substantially fully overlapping one another in their unlocked condition when lying in a plane defined by the top of the tray, but which become interlocked when they are urged past their over center position inside the tray to provide the sole means for retaining each product supporting panel in its acute angular position within the tray.

2. The tray of claim 1 wherein the second pair of locking flaps lie in a plane above and substantially in contact with the plane of the bottom panel in their interlocked condition.

* * * * *